US005803713A

United States Patent [19]

Huse

[11] Patent Number: 5,803,713

[45] Date of Patent: Sep. 8, 1998

[54] MULTI-STAGE LIQUID RING VACUUM PUMP-COMPRESSOR

[76] Inventor: Henry Huse, Little Brook Rd., Darien, Conn. 06820

[21] Appl. No.: 704,262

[22] Filed: Aug. 28, 1996

[51] Int. Cl.[6] ..... F04C 19/00

[52] U.S. Cl. ..... 417/68; 417/244

[58] Field of Search ..... 417/68, 69, 244

[56] References Cited

U.S. PATENT DOCUMENTS 4,334,830 6/1982 Haavik ..... 417/68

FOREIGN PATENT DOCUMENTS 1007939 5/1957 Germany ..... 417/68
121519 12/1918 United Kingdom ..... 417/68
377476 7/1932 United Kingdom ..... 417/68

*Primary Examiner*—Richard E. Gluck
*Attorney, Agent, or Firm*—Kane, Dalsimer, Sullivan, Kurucz, Levy, Eisele and Richard, LLP

[57] ABSTRACT

A multiple stage axial flow liquid ring vacuum pump having pumping stages integrated in a single rotor rotating around a central port cylinder with multiple inlet and discharge ports, with axial flow arrangement enabling the pump to achieve higher vacuum than that obtainable by existing single-stage and two-stage pump designs.

11 Claims, 4 Drawing Sheets

MULTI-STAGE LIQUID RING VACUUM PUMP-COMPRESSOR

BACKGROUND

This invention relates to liquid ring vacuum pumps and compressors.

The liquid ring pumping principle is a well established art. Typically, a liquid ring pump consists of a multi-bladed rotor mounted on a shaft and arranged so as to rotate freely within an eccentric or elliptical casing. Liquid introduced in the casing is acted upon by the blades of the rotor, and centrifugal force causes the water to form a ring which follows the inner contour of the casing. As the ring surges outward and inward in alternation it creates a piston action in the buckets formed by the rotor blades, and this action is employed to suck in air or gas on the outward stroke and compress it on the inward stroke. Port openings, either centrally located or on the sides of the rotor, provide inlet and discharge means for the gas being pumped.

On vacuum applications the ultimate vacuum achievable is determined by such design consideration as internal clearances, hydraulic friction, rotational speeds, blade angles, and ratio of eccentricity. Non-design factors such as fluid viscosity, gas density, and liquid vapor pressure, also play a role in the performance characteristics of the liquid ring pump.

Currently available liquid ring vacuum pumps typically operate at a maximum effective vacuum of 25 to 27 inches Hg vacuum, or a compression ratio of 10 to 1. By running vacuum pumps in series the effective operating range can be extended to approximately 28" Hg vacuum, or a compression ratio of 15 to 1. This invention provides a pump capable of 30 to 1 compression ratio in two stage utilizing 60° F. water as a seal fluid.

Two-stage liquid ring vacuum pumps are available in a number of configurations. Flat sided pumps have suction and discharge ports located on a flat plate perpendicular to the pump shaft and the rotor inlet and discharge is located on the side adjacent to the port plate. This design requires close tolerance between the rotor and the port plate in order to reduce slip losses. In a two-stage configuration these pumps normally employ two separate rotors mounted on a common shaft and two separate port plates. The two pump stages are normally connected by an external crossover conduit, or in some designs a conduit integrated in the casing itself. These pumps are essentially two separate pumps connected in series and assembled on a common shaft.

The other pump design employs a centrally located port cylinder or cone around which the rotor spins. The inlet and discharge port openings are oriented parallel to the pump shaft and the liquid pistons act perpendicular to the pump shaft. As in the case of the flat sided pump of current design these two-stage pumps also separate the stages by means of external conduit or a conduit integrated in the casing.

In both of the designs cited above an intricate system of passages and conduits are required to connect the two pump stages for series operation. The flow of liquid and air or gas in combination creates friction losses, slip, and hydraulic inefficiencies that restrict the performance of the pumps.

SUMMARY OF THE INVENTION

The multi-stage liquid ring vacuum pump described in this invention is equally adaptable for use as a vacuum pump or as a compressor.

The primary object of the invention is to provide a means whereby the pumping stages are integrated in a single rotor which rotates freely around a single cylindrical or conical porting member which contains inlet and discharge ports for each pump stage. This multistage arrangement, combined with axial flow of liquid and air or gas provides a clean and unobstructed path for the liquid and gas being pumped, with subsequent reduced friction losses.

A further object of the invention provides for a compact multistage liquid ring pump because the stages are not separated but integrated in a single rotor.

It is an object of the invention to provide a multistage liquid ring pump that has no valves or internal control devices to regulate the volumetric displacement between pumping stages. The open and unimpeded flow passages provide for self regulation of the fluid flow.

The most common arrangement of the invention is for two-stage design, since most applications would utilize water as a seal fluid and air or dense gas as the fluid being pumped. The exceptional performance of the two-stage liquid ring pump makes it ideal for high wet vacuum applications such as condensers, evaporators, autoclaves, and similar industrial applications. However, when pumping low density gases such as hydrogen and helium three or more stages could be used so as to reduce slip losses and improve pumping efficiency. The multi-stage pump, in the application for which the invention was designed, can be used with a wide variety of seal liquids and gases.

An object of the invention is to provide two or more pump stages arranged for axial flow from stage to stage with the first stage displacing a given volume of gas and each succeeding stage having reduced volumetric displacement to hatch the compression ratio across each stage of compression.

Another object of the invention is to provide a sleeve around the centrally positioned port cylinder or cone. The sleeve would be provided with inlet and discharge ports as described above, and it could be constructed of composite material having high wear resistance, teflon® for lubricity and low friction, or other metallic or non metallic materials having advantageous physical and chemical properties.

An additional object of the invention is to provide a single mechanical seal assembly located at the discharge of the second pumping stage, said mechanical seal assembly immersed in the seal fluid which cools and lubricates the seal faces. By positioning the seal in the pump discharge the seal is not subjected to vacuum and the pressure differential across the seal is negligible, ensuring long life with minimal wear.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
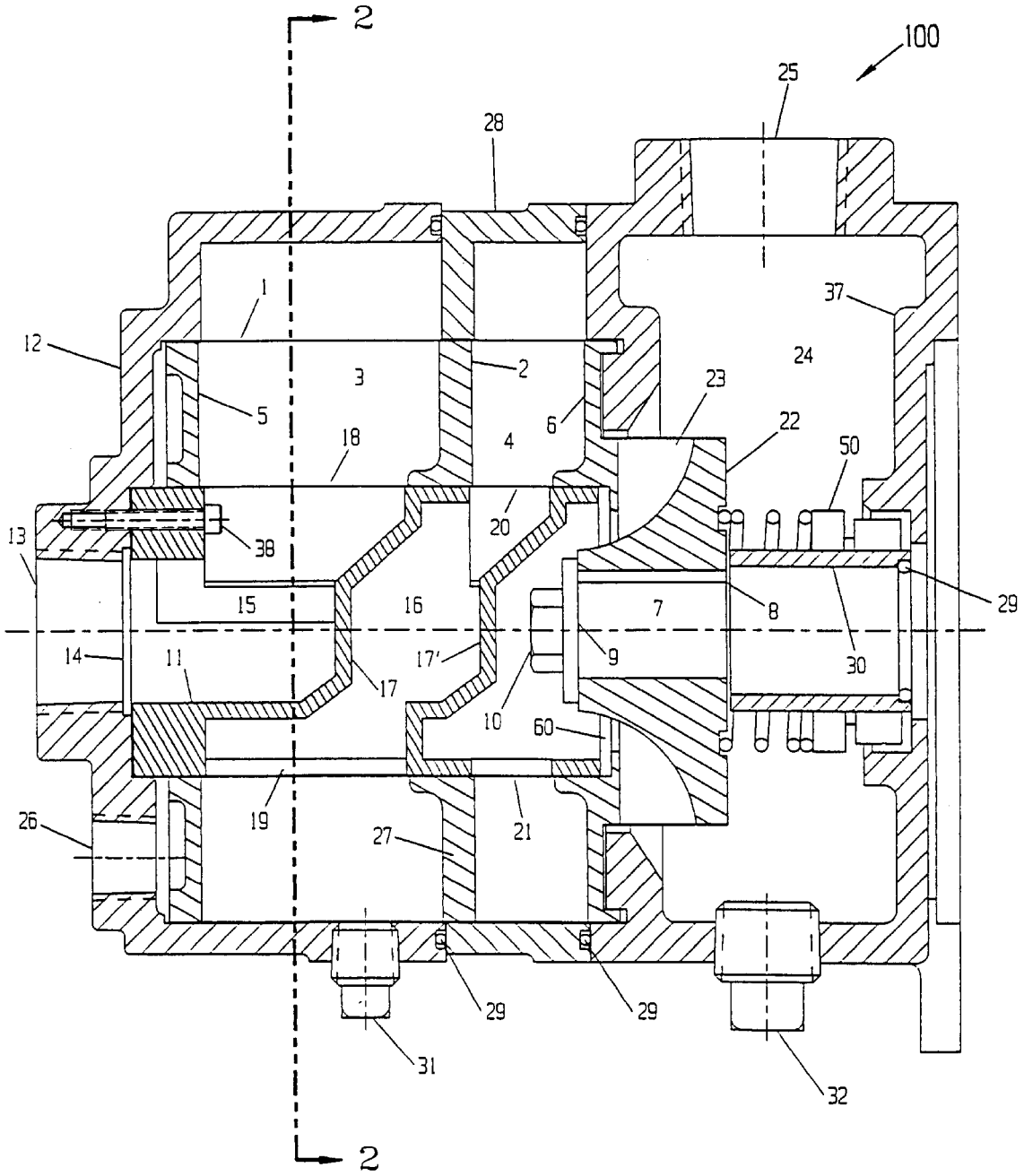
FIG. 1 is a side cross-sectional view of the apparatus of the present invention.
Figure 2:
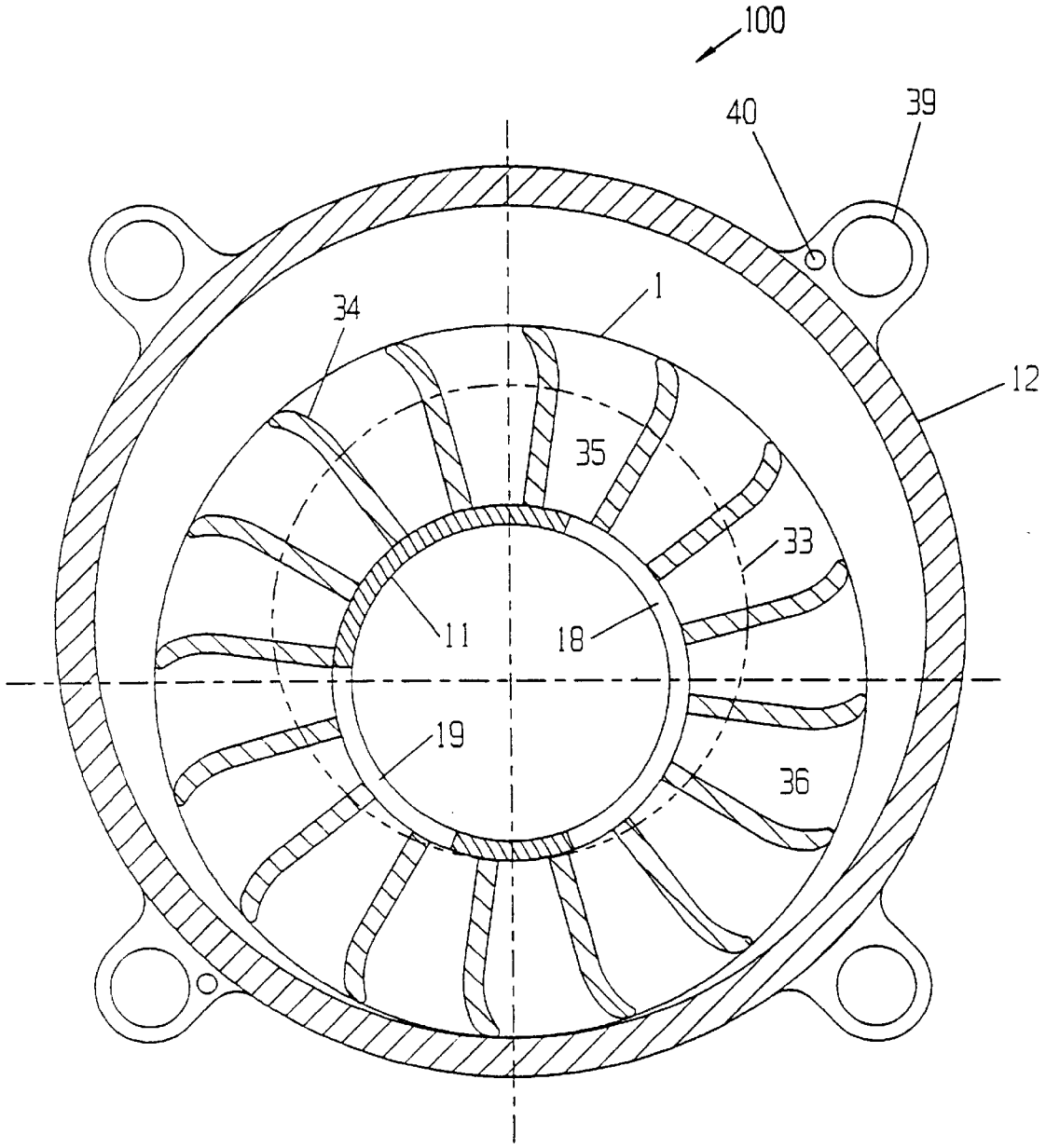
FIG. 2 is a front cross-sectional view taken along section 2—2 of FIG. 1 showing the rotor and eccentric casing of the present invention.

Referring now to the drawings in detail wherein like numerals indicate like elements throughout the several views, one sees that FIG. 1 is a side cross-sectional view of the liquid ring pump 100 of the present invention, and that FIG. 2 is a front plan view of a single stage of the multiple stage liquid ring pump 100 of the present invention. As shown in FIG. 2, rotor 1, which includes a plurality of blades 34 which are generally radially oriented with a distal end bent slightly in the direction of rotation, is journaled for rotation about a stationary port cylinder 11 which includes inlet port 18 and discharge port 19 about a periphery thereof. Port cylinder 11 is placed within an eccentric position in cover lobe 12 and held in a stationary position to first stage cover lobe by screws 38.

As shown in FIG. 1, the rotor 1 includes a planar interstage wall 2 which separates the first stage chamber 3 from the second stage chamber 4. Both first stage chamber 3 and second stage chamber 4 are enclosed at each end by shroud 5 and 6. Rotor 1 is attached to input shaft 7 by key 8, washer 9 and lock bolt 10. The shaft 7 receives rotary input from an external source such as a motor (not shown). External casing 37 is secured to a pedestal or secured to the external source of rotary input such as a motor (not shown).

As shown in FIG. 2, in the single lobe configuration, the liquid ring 36 is alternately cast away from and forced into the center of rotor 1 (which is illustrated as rotating counterclockwise in FIG. 2). This action creates liquid pistons formed by the interior surface 33 of the liquid ring confined by rotor blades 34, the rotor shroud 5 and the interstage wall 2. The liquid pistons create air pockets 35 which are transported from the suction port 18 to the discharge port 19. During the cycle, the gas is compressed and the heat of compression is absorbed in the liquid ring 36.

As further shown in FIG. 2, the first stage cover lobe 12, the second stage cover lobe 28, and the casing 37 are secured by bolts 39 and the components are held in precise position by dowel pins 40. Rabbets or mating machined shoulders could also be used to position the parts.

Figure 4:
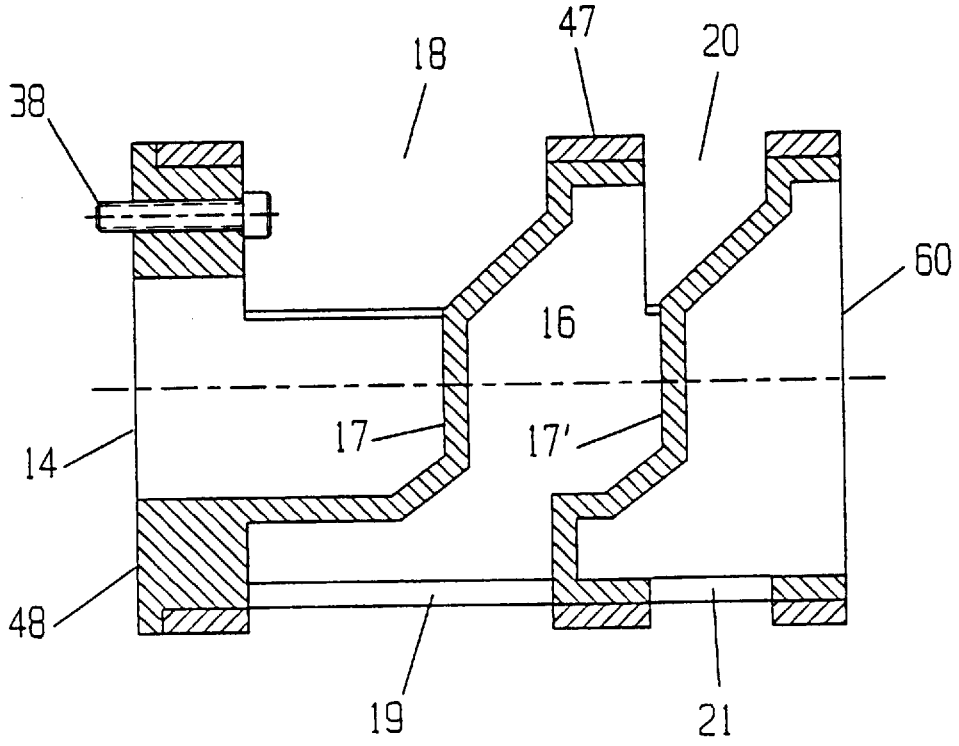
FIG. 4 is a cross-sectional view of the port cylinder sleeve of the present invention.

As further shown in FIG. 4, port cylinder 11 includes a port cylinder sleeve 47 which is outwardly concentric from central port member 48. Port cylinder sleeve 47 is bonded to central port member 48 which is affixed to the pump assembly by screws 38. Depending on the material, the port sleeve 47 can be secured to the central port member 48 by shrink fit, adhesive, or set screws (not shown). Port cylinder 11 includes a port cylinder inlet port 14 through a first longitudinal end thereof and a port cylinder discharge port 60 on a second longitudinal end thereof. Additionally, the cylindrical periphery of port cylinder 11 includes a first stage inlet aperture 18, a first stage outlet aperture 19, a second stage inlet aperture 20 and a second stage outlet aperture 21. First stage inlet aperture 18 and second stage inlet aperture 20 are axially offset from each other. Likewise, first stage outlet aperture 19 and second stage outlet aperture 21 are axially offset from each other. Both first stage inlet aperture 19 and second stage inlet aperture 21 are opposed from first stage inlet aperture 18 and second stage inlet aperture 20. The gas communication path from port cylinder inlet 14 to first stage inlet aperture 18 is separated by diagonal wall 17 from the gas communication path (interstage chamber 16) from first stage outlet aperture 19 to second stage inlet aperture 20. Likewise, the gas communication path from first stage outlet aperture 19 to second stage inlet aperture 20 (interstage chamber 16) is separated by diagonal wall 17' from the gas communication path from second stage outlet aperture 21 and port cylinder discharge port 60. This construction, along with the planar interstage wall 2 which separates the first stage chamber 3 and second stage chamber 4, allows gas to be received via port cylinder inlet 18 to first stage inlet aperture 18 and undergo a first stage of pumping or compression in first stage chamber 3, be discharged via first stage outlet aperture 19 and communicated via interstage chamber 16 to second stage inlet aperture 20 and undergo a second stage of pumping or compression in second stage chamber 4, then be discharged via second stage outlet aperture 21 and port cylinder discharge port 60. Port cylinder discharge port 60 is in communication with pump outlet 25 through via vanes 23 of rotor hub 22 and discharge chamber 24 as shown in FIG. 1. Both the first and second stage pumping or compression is performed by a single rotor 1. Additional stages could be provided by providing additional compression stage chambers divided by additional planar interstage walls and additional gas communication paths within the port cylinder 11. Third and subsequent stages would typically have a diminished volumetric displacement.

During operation, the pump is supplied continuously with a supply of liquid, normally water, through the seal liquid inlet 26. This liquid forms a ring created by centrifugal force which follows the eccentric form of the first stage cover lobe 12, and the liquid ring forms liquid pistons with the chambers created by the rotor blades and shrouds 5 and 6 and interstage shroud 27. Liquid and the air or gas being pumped follow a flow path from the first stage to the second stage where the liquid ring is reformed by following the eccentric form of the second stage cover lobe 28 where the pumping action is repeated. The first stage cover lobe 12, second stage cover lobe 28 and casing 37 are sealed off by O-rings 29. Liquid discharged through hub 22 via vanes 23 partially floods chamber 24 where it provides cooling and lubrication for mechanical seal 50 which is fitted on shaft sleeve 30. The three components are secured by bolts (not shown) and positioned by means of machined rabbets (not shown) or dowels (not shown). Plugs 31 and 32 are provided as drains.

Figure 3:
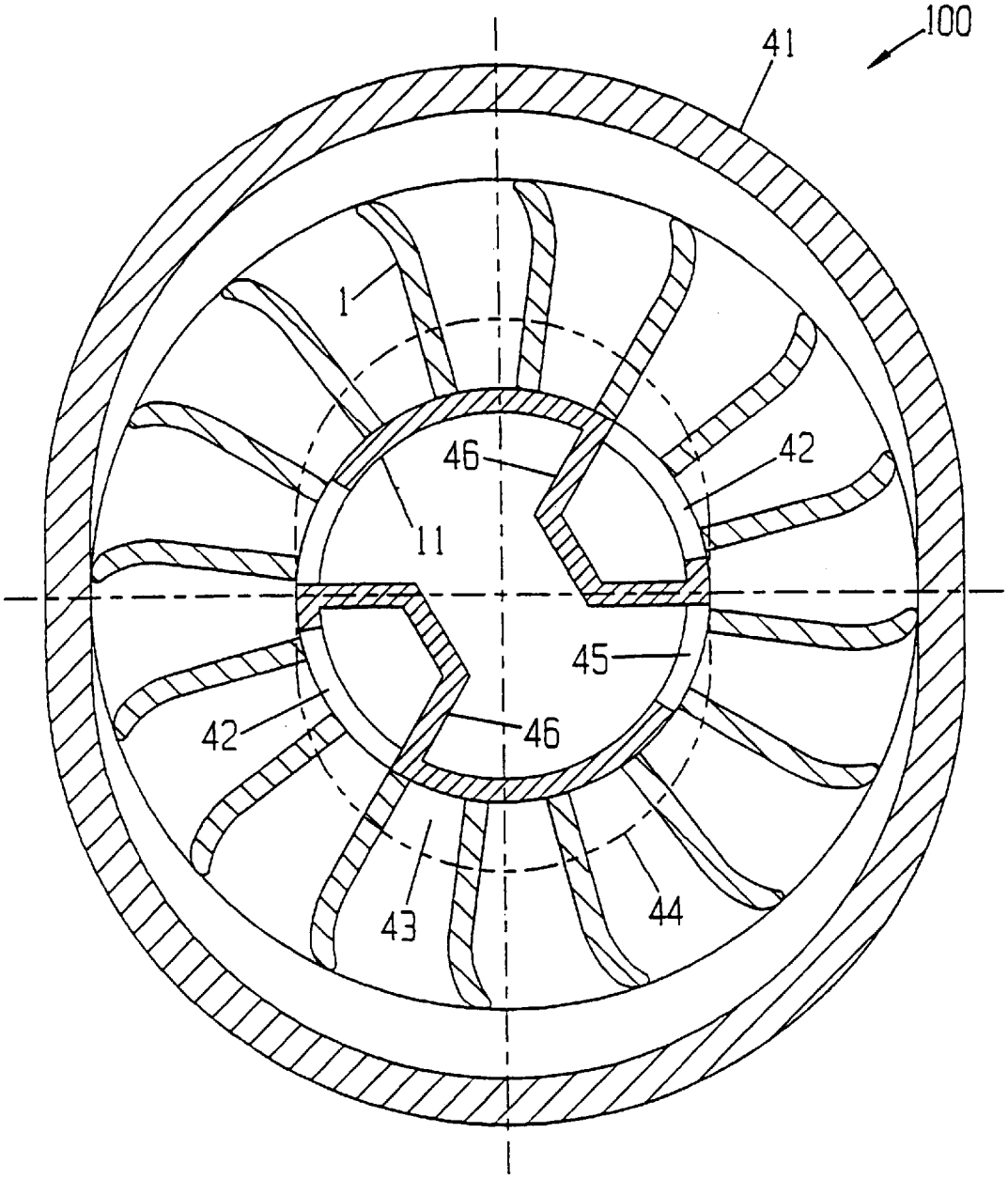
FIG. 3 is a front cross-sectional view showing the rotor and an alternative elliptic casing.

FIG. 3 is a cross-sectional view of the embodiment of the liquid ring pump 100 of the present invention which uses an elliptical casing instead of the eccentric casing as shown in FIG. 2. An elliptical design allows for two pumping cycles per revolution, as opposed to one pumping cycle per revolution as in the case of the eccentric circular design. This design is particularly adaptable to compressor applications where high pressures create high radial loads. The two-lobe design provides for balanced radial forces which reduce shaft deflection caused by unbalanced radial loads.

As illustrated in FIG. 3, rotor 1 spins freely within elliptical casing 41 around the port cylinder 11. Port cylinder 11 is provided with two diametrically opposed inlet ports 42 which provide a passage for air or gas to be sucked into the space 43 formed by blades of rotor 1 and the liquid ring 44. During one half revolution of the rotor 1, the air or gas is compressed and discharged through discharge ports 45. The inlet ports 42 and the discharge ports are separated by walls 46. The embodiment of FIG. 3 otherwise includes elements similar to those of the embodiment of FIG. 2, including the axially separated compression or pumping stages.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A liquid ring pump including:

a casing defining an interior compression space;

a port cylinder within said interior compression space;

a bladed rotor journaled for rotation about said port cylinder, said bladed rotor including a wall for axially dividing said interior compression space into a first stage compression space and a second stage compression space;

means for providing a liquid within said interior compression space to form a ring about an interior of said casing, thereby providing a compression action within said first stage compression space and said second stage compression space upon rotation of said bladed rotor;

said port cylinder including a port cylinder inlet; a port cylinder discharge; a first stage inlet aperture and a first stage outlet aperture in communication with said first stage compression space; and a second stage inlet aperture and a second stage outlet aperture in communication with said second stage compression space; said port cylinder further providing a first gas communication path from said port cylinder inlet to said first stage inlet aperture, a second gas communication path from said first stage outlet aperture to said second stage inlet aperture, and a third gas communication path from said second stage outlet aperture to said port cylinder discharge;

whereby gas enters said first compression space by said first gas communication path, is compressed within said first gas compression space by rotation of said bladed rotor, is communicated to said second compression space by said second gas communication path, is further compressed within said second gas compression space by rotation of said bladed rotor, and is communicated by said third gas communication path to said port cylinder discharge.

2. The liquid ring pump of claim 1 wherein said port cylinder further includes a sleeve concentric with said bladed rotor.

3. The liquid ring pump of claim 2 wherein said port cylinder is generally cylindrical in shape with said port cylinder inlet at a first axial end thereof, said port cylinder discharge at a second axial end thereof, and said first and second inlet and outlet apertures on a lateral periphery thereof.

4. The liquid ring pump of claim 3 wherein said first gas communication path and said second gas communication path are separated from each other by a first internal wall within said port cylinder.

5. The liquid ring pump of claim 4 wherein said second gas communication path and said third gas communication path are separated from each other by a second internal wall within said port cylinder.

6. The liquid ring pump of claim 5, wherein said first and second internal walls are formed at least partially at an oblique angle to a longitudinal axis of said port cylinder.

7. A liquid ring pump including:

a casing defining an interior compression space;

a port cylinder within said interior compression space;

a bladed rotor journaled for rotation about said port cylinder, said bladed rotor including at least one wall for axially dividing said interior compression space into a plurality of successive stage compression spaces;

means for providing a liquid within said interior compression space to form a ring about an interior of said casing, thereby providing a compression action within said plurality of successive stage compression spaces upon rotation of said bladed rotor;

said port cylinder including a port cylinder inlet, a port cylinder discharge, and, for each of said successive stage compression spaces, an inlet aperture and an outlet aperture, said port cylinder further providing a first gas communication path from said port cylinder inlet to said inlet aperture of a first of said plurality of successive stage compression spaces, a successive gas communication path to each inlet aperture of a subsequent successive stage compression space from an outlet aperture of a prior stage compression space, and a final gas communication path from an outlet aperture of a final stage compression space to said port cylinder discharge;

whereby gas enters said first of said successive stage compression spaces by said first gas communication path, is compressed within said first of said successive stage compression spaces by rotation of said bladed rotor, is communicated to subsequent successive stage compression spaces by said successive gas communication paths, is further compressed within each of said subsequent successive stage compression spaces by rotation of said bladed rotor, and is communicated by said final gas communication path to said port cylinder discharge.

8. The liquid ring pump of claim 7 wherein said port cylinder further includes a sleeve concentric with said bladed rotor.

9. The liquid ring pump of claim 8 wherein said port cylinder is generally cylindrical in shape with said port cylinder inlet at a first axial end thereof, said port cylinder discharge at a second axial end thereof, and said inlet and outlet apertures on a lateral periphery thereof.

10. The liquid ring pump of claim 9 wherein said gas communication paths are separated from adjacent successive gas communication paths by internal walls within said port cylinder.

11. The liquid ring pump of claim 10 wherein said internal walls are formed at least partially at an oblique angle to a longitudinal axis of said port cylinder.

* * * * *